US005984248A

United States Patent [19]

Evans et al.

[11] Patent Number: 5,984,248

[45] Date of Patent: Nov. 16, 1999

[54] LAMP-HOLDING HOOK CLAMP AND CONNECTOR KEYWAY

[75] Inventors: Nigel Evans, Sutton Coldfield; William E. Hewlett, Walmley; Richard Parker, Kings Hgatm, all of United Kingdom

[73] Assignee: Light & Sound Design, Ltd., Birmingham, United Kingdom

[21] Appl. No.: 08/687,927

[22] Filed: Jul. 30, 1996

Related U.S. Application Data

[63] Continuation-in-part of application No. 08/453,505, May 30, 1995, Pat. No. 5,702,082.

[51] Int. Cl.[6] ..... F21L 15/08; F21L 21/00

[52] U.S. Cl. ..... 248/214; 248/229.13; 248/230.4

[58] Field of Search ..... 248/214, 230.4, 248/316.5, 231.51, 229.13, 229.23, 340, 225.21, 230.1, 228.4, 229.24, 228.5

[56] References Cited

U.S. PATENT DOCUMENTS

| | | | |
|---|---|---|---|
| 567,157 | 9/1896 | Noyes | 248/231.51 |
| 577,429 | 2/1897 | Homan | 248/230.4 |
| 1,547,065 | 7/1925 | Noble | 248/229.13 |
| 1,760,458 | 5/1930 | Weber | 248/229.13 |
| 3,706,437 | 12/1972 | Eberhardt | 248/230.4 |
| 3,784,140 | 1/1974 | Auerbach | 248/214 |
| 3,936,023 | 2/1976 | Clifton | 248/228.5 |
| 4,225,104 | 9/1980 | Larson | 248/316.5 |
| 5,312,079 | 5/1994 | Little, Jr. | 248/214 |
| 5,584,457 | 12/1996 | Fawcett | 248/229.1 |

FOREIGN PATENT DOCUMENTS

| | | | |
|---|---|---|---|
| 889181 | 12/1971 | Canada | 248/316.5 |

*Primary Examiner*—Ramon O. Ramirez
*Assistant Examiner*—Anita M. King
*Attorney, Agent, or Firm*—Fish & Richardson P.C.

[57] ABSTRACT

A hook clamp has surfaces allowing the clamp to be placed on a support and clamped thereto. The surfaces are such that the clamp can be placed on the support and its weight held by the support prior to tightening. The clamp has a built-in connector for supplying power to the lamp. The clamp has one or more fail-safe holes for securing the clamp to the support with a safety cable. The clamp also has one or more flanges that can be received by a separate mounting bracket, for mounting the clamp and any attached element during storage, staging, or when otherwise not being used.

25 Claims, 8 Drawing Sheets

LAMP-HOLDING HOOK CLAMP AND CONNECTOR KEYWAY

This is a continuation-in-part of U.S. patent application Ser. No. 08/453,505, Entitled "Hook Clamp", and filed May 30, 1995, now U.S. Pat. No. 5,702,082.

FIELD OF THE INVENTION

The present invention relates to a clamp for holding a stage-mounted device relative to a stage support truss. More specifically, the present invention defines a hook clamp which holds the weight and position of the stage-mounted device while it is being mounted to the support truss, and also has an electrical connector extending through the clamp.

BACKGROUND AND SUMMARY

Many stage-mounted devices require a stable base of support. Moving stage lights are often particularly sensitive to such requirements. Typically, moving lights are electronically controllable to move between various positions and to provide special effects. The position of a moving light, however, is accurate only when the system has a very stable base of support. Moreover, because of the lamp size, cooling requirements, and complicated electronics, these lamp devices can be very heavy. Many times such lights are mounted at the upper area of the stage, very high off the ground.

Many lamp clamps are known in the art. Some of the commonly used ones are described herein. A Cheeseborough clamp (U.S. terminology) or Scaff clamp (U.K. terminology) is shown in FIG. 1. The clamp 100 is shown in its open position in FIG. 1. The moving part 122 of the clamp pivots around pivot point 104 to form a closed clamp as shown in FIG. 2 which closes around the supporting pole or pipe. The clamp can be tightened by tightening bolt 106 relative to bolt accepting mechanism 108, which can be a slot or the like in a plate. The appropriate tightening reduces the size of the inner surfaces, to tighten the clamp and to maintain the lamp in position relative to pole 200.

The inventors of the present invention recognized that this system is very difficult for the installers to use. One main reason is because the entire weight of the lamp must be supported by the installer while attaching the lamp to the pole 200. FIGS. 1 and 2 show these clamps in the open and closed position, respectively to demonstrate the installation. In order to install the lamp, the installer must hold lamp 110 while placing the open clamp 100 against pole 200 and while holding surface 120 of the open clamp against the supporting pole 200. The clamp is hinged around pivot 104 to form a cylindrical inner area 205, as shown in FIG. 2. Bolt 106 holds relative to bolt accepting element 108.

In order for the lamp to be properly attached to the supporting pole 200, therefore, the bolt 106 must be screwed into the accepting element 108 (e.g., a nut or a split holder). Alternately, a wing nut or like mechanism on element 108 can be screwed into bolt 106. In any of those cases, the installer must hold the weight of the lamp, which can be as heavy as 60 pounds, while holding the clamp closed and simultaneously screwing the nut into place. Moreover, even once the nut is screwed into place, the lamp is still not maintained in its proper position relative to the pole until the nut and screw 106, 108 are properly tightened.

These most-common kind of lamp clamps have been recognized by the inventors of the present invention to cause problems, making the lamps very difficult to install.

A second kind of mounting mechanism is shown in FIG. 3. The lamp 110 is connected to a folded piece of metal 300 which includes vertically extending portions 302 and 304, and a horizontal portion 306. The inside surface 308 of clamp 300 is placed against the supporting pipe 200. Since the metal 300 is formed of folded flattened metal sheets, the inside surface 308 touches the pole 200 only at tangent points between the flat surfaces and the round pipe, such as 310. Rotation of lamp 110 relative to pole 200 is prevented by tightening set screw 312 against point of contact 314 on the pole 200.

There are still problems with this system. Significantly, this system allows the weight of the lamp to be placed on the pole prior to tightening the set screw 312. However, the lamp can still rotate relative to the pole, at least until the set screw is tightened against the pole. Moreover, this design tends to distort the roundness of the pole because of the large amount of force at the location 314 where the set screw 312 touches the pole. As can easily be seen, moreover, the system is inherently unbalanced.

A different, but similar kind of prior art clamp is shown in FIG. 3A. That clamp includes the same basic structure as shown in FIG. 3. It includes the set screw 312 which presses against a portion of the support pole 200. Ridges 350 and 352 provide extra friction to hold the lamp relative to the pole.

Power must also be applied to the lamp. Typically the power travels either along the pole or along a separate conduit which is near the pole. The inventors of the present invention have recognized the inconveniences and difficulties which often occur in getting the power to the lamp.

Since the lamps are very heavy, it is also important to ensure that the lamp does not fall from its position on the pole. Accidents can happen, for example, if a technician fails to properly secure the lamp to the pole, or if the securing mechanism fails. Such accidents risk both damage to very expensive equipment, as well as a serious threat to stage workers. One aspect of the present invention proposed a fail-safe mechanism for a lamp.

It is also desirable that the lamp mounting mechanism be versatile in its selection of mounting techniques. One particularly interesting mounting technique is a floor mounting. This technique uses a plate or other support base holding special flanges on the clamp. Those flanges position the lamp and clamp "upside down" relative to the position in which the lamp would be if pole mounted.

It is an object of the present invention to provide a clamp which allows flexibility and safety by special techniques which can be used individually or in combination. This is done according to the present invention by providing an element which has interior surfaces defining an area which approximates in shape the outer surface of the supporting truss, over at least over half of the outer surface of the truss support. This ensures maximal frictional contact between the support and the clamp. This friction maintains the lamp in its proper position relative to the truss, even prior to frictional tightening.

A movable element tightens a tightening device into contact with the support element to further maintain the lamp in position. The inventor recognized that the combination of an inner surface approximating the outer surface of the support pole, and a design that allows hooking over the support pole produces a much easier-to-use system.

Structure is provided in the clamp that facilitates the channelling of power to the lamp. One aspect of this invention includes a special structure incorporated within the clamp which facilitates power routing to the lamp. This structure includes surfaces defining a special hole in a special location on the clamp. A special connector receives power and routes the power to a power conduit. That power conduit is routed around the rear of the connector through another hole and into the lamp. This aspect facilitates application of power to the lamp without the need to provide a separate external power conduit.

Another feature of the present invention uses a fail-safe mechanism which allows a safety cable through the clamp and around the pole. A technician mounting the lamp can initially connect the safety cable to avoid the lamp falling or the like while it is being installed.

Another feature of the present clamp provides two separate mounting surfaces: a first surface which allows connection to a support pole such that the clamp is secured in a first orientation, and a second surface which allows connection in a way such that the clamp is secured in a second orientation, different than the first orientation. The preferred surfaces include pole mounting surface, mounting the lamp on the bottom of the clamp, and a floor mounting surface mounting the lamp on the top of the clamp.

BRIEF DESCRIPTION OF THE DRAWINGS

These and other aspects of the invention will now be described in detail with reference to the accompanying drawings, wherein.

DESCRIPTION OF THE EMBODIMENTS

Figure 4:
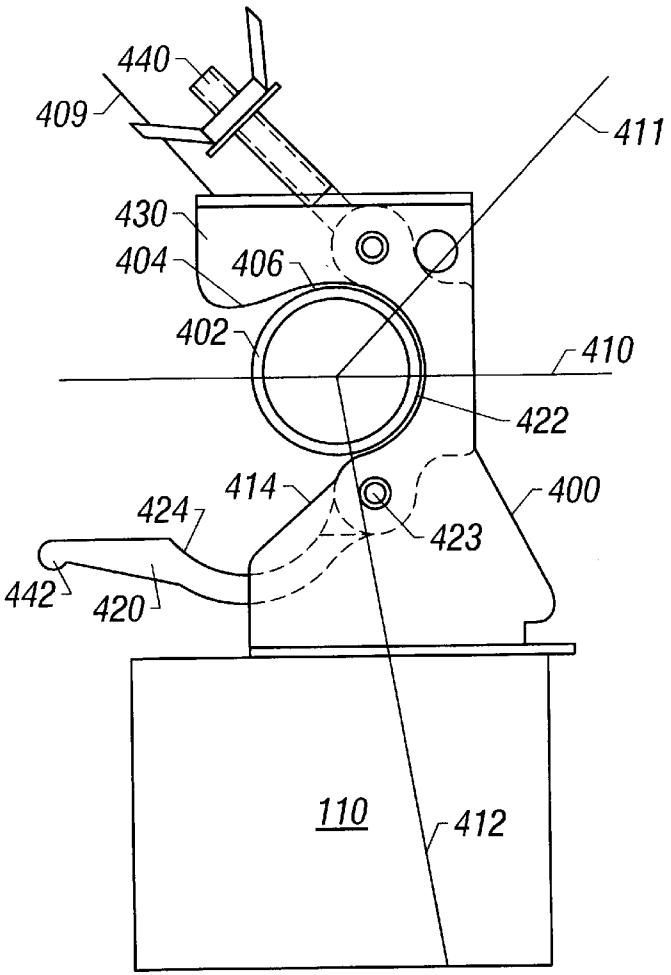
FIG. 4 shows a side view of the clamp of the present invention in the open position.

FIG. 4 shows a first embodiment of the invention which includes lamp 110 connected to the hook clamp 400 of the present embodiment. More generally, any load could be attached to hook clamp 400. Hook clamp 400 is adapted to surround a substantially cylindrical support 402 to hold the weight of lamp 110. Support 402 is conventionally a pole, although it could be of any shape.

The hook clamp includes inner surfaces 404 which are substantially the same size and shape as the outer surface 406 of the support 402. By this is meant that the inner surfaces are sized and shaped similarly to the support. The shapes are sufficiently similar that there is a maximal amount of friction between the clamp and support to keep the clamp in position even prior to tightening. This embodiment attaches to a cylindrical support element 402, and surfaces 406 at least along a portion of the clamp are similarly cylindrical. The line 410 indicates a dividing line. Inner surfaces 404 above the dividing line 410 are cylindrical in shape and of substantially similar shape to the outer surface 406 of the support. The portions between lines 411 and 412 are also cylindrical. The pressure of outer surface 406 of pole 402 against inner surface 428 of hook portion 430 presses cylinder 402 into cylindrical surface area 422—at least between lines 411 and 412, and more preferably between lines 409 and 412. The surface 414 preferably includes relatively flat surfaces against which the pole is pressed during the initial time while the hook portion 430 is being secured into position over the pole 402.

Figure 1:
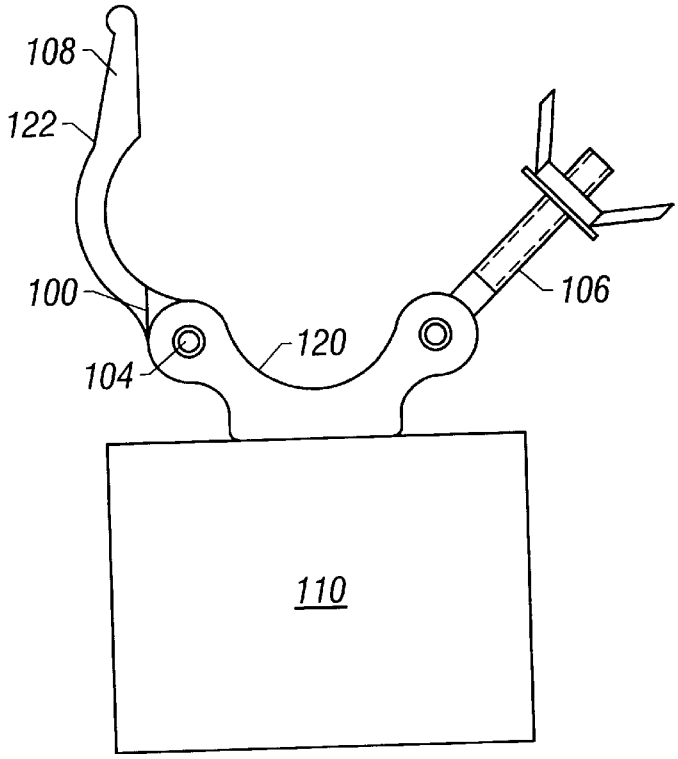
FIG. 1 shows a Cheeseborough clamp of the prior art in the open position.
Figure 2:
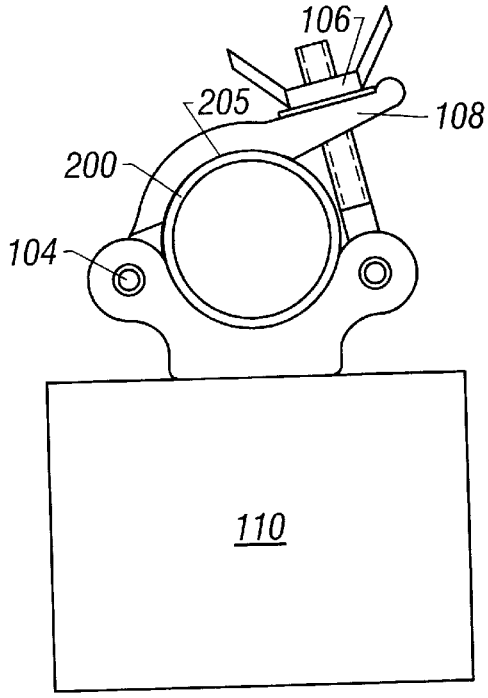
FIG. 2 shows the Cheeseborough clamp in the closed position.
Figure 3:
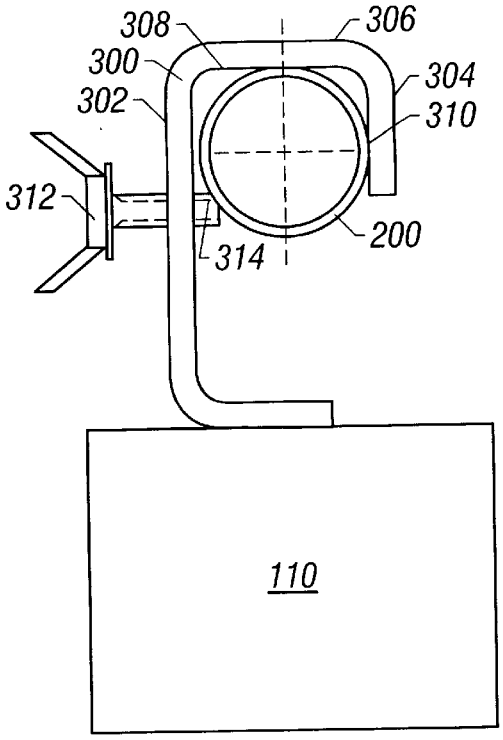
FIG. 3 shows another clamp of the prior art.
Figure 3A:
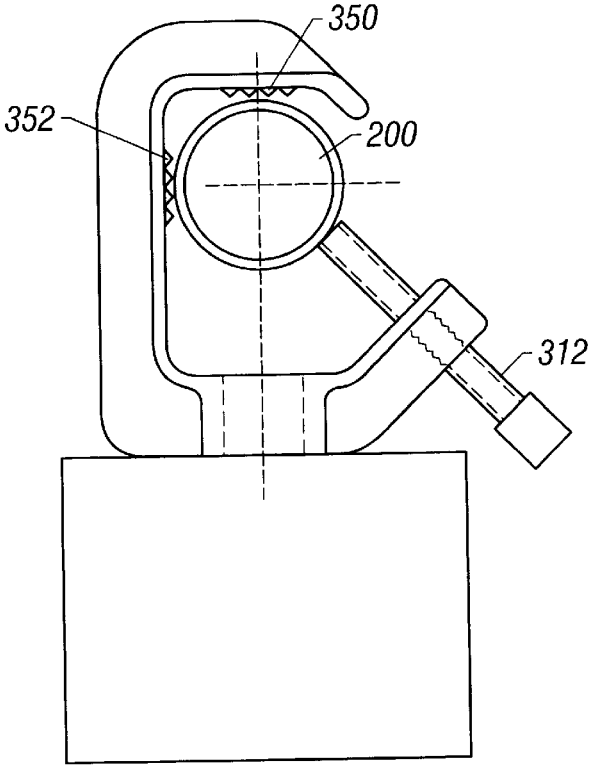
FIG. 3A shows a modification of the FIG. 3 clamp.
Figure 5:
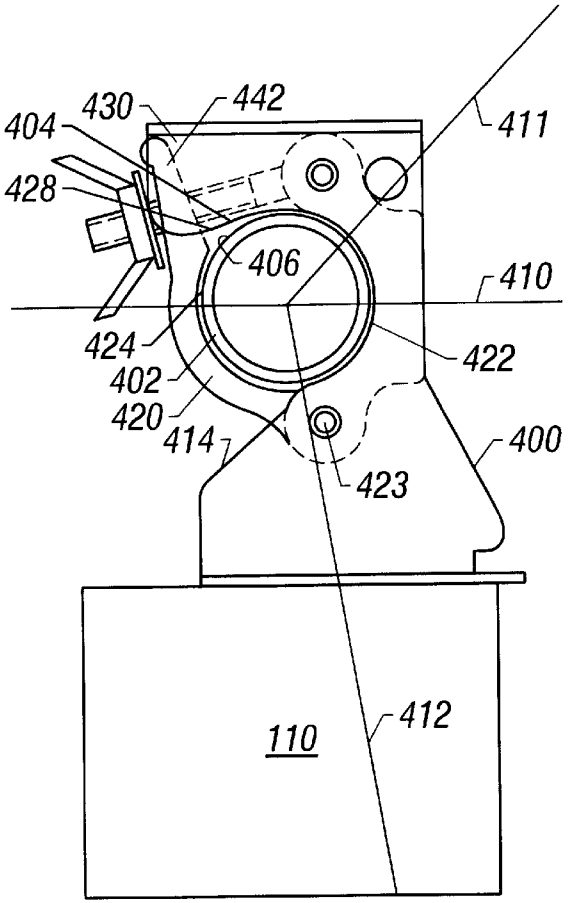
FIG. 5 shows the clamp of the present invention in the closed position.

The tongue 420 pivots around its pivot point 423, and can be moved into a position where the inside surface 424 fictionally engages against the support member 402. This final position is shown in FIG. 5, with the surface 424 abutting against the outer surface of the support 402. The outer surfaces 406 of the support which are above the line 410 also abut against the inner surfaces 404 of the internal cylindrical element. Inner surface 424 of the tongue is preferably concave and similar in shape to the outer surface of support 402.

In operation, the user "opens" the tongue 420 by lowering it to its lowermost position shown in FIG. 4. The user first hooks the device over the support member 402. The support member 402 comes in contact with surface 414. The clamp can slide with the flat surface 414 against the pole. The clamp slides until the hooked end 430 is located above and hooked over the support 402. At that time, the outer surfaces 402 of support 402 contact inner surfaces 404 of the clamp 400. The lamp 110 is preferably located at the center of gravity of the clamp, to minimize side-to-side torque on the clamp. The friction of the close fit between the inner surfaces of the clamp and the outer surfaces of the support pole therefore are preferably sufficient to keep the lamp steady and in position.

The tongue 420 is then lifted into position, placing the bolt 440 into a corresponding notch 442 to close the clamp as shown in FIG. 5. Notch 442 can be formed in hooked end portion 430 or in tongue 420. When the bolt is tightened, it holds the inside surface 424 into close frictional contact with the support 406. This tightens the clamp around the pole, so that the support is fictionally held by many similar-shaped surfaces. Since many surfaces of the pole are held, less tightening is necessary and hence there is less chance of distorting the pole shape. Preferably, many of the parts of the clamp are of similar shape to the outer surface of the pole. All portions above the line 410 are of similar shape, and preferably this is approximately 140° of the circle defined by the cylinder. Preferably all portions between the lines 411 and 412 also define arcs which are circular and which hence closely approximate the shape of the pole. The position from the left part of line 410 to the right part of line 412 preferably defines about 250° of the circle. An additional 30° or so also has similar shaped elements in the surface 424. Accordingly, preferably 280° of the circle defined by the cylinder are substantially the same shape as the surface of the pole. This means that only 80° is not the same shape as the support pole. Thus 280/360, or approximately 75 percent, of the outer surface of the pole is preferably gripped by similar-shaped surfaces of the clamp.

The above-described first embodiment has the significant advantage of allowing frictional holding of the lamp even prior to tightening. This frictional holding, combined with the advantageous structure of the lamp hook of the present invention keeps the lamp hooked in place on the support pole.

A second embodiment of the present invention includes additional structure.

Figure 6:
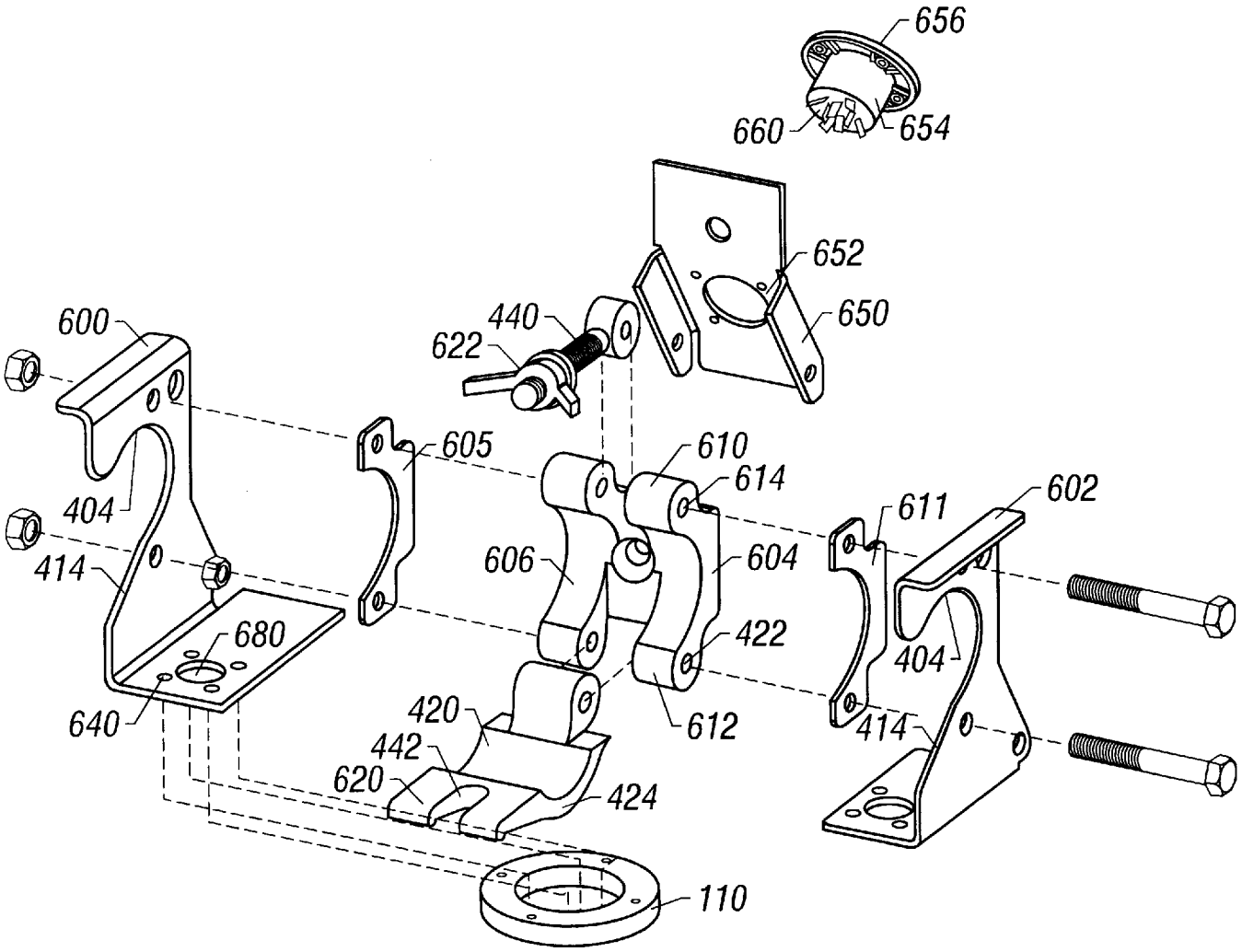
FIG. 6 shows an exploded view of the clamp of the present invention.
Figure 7:
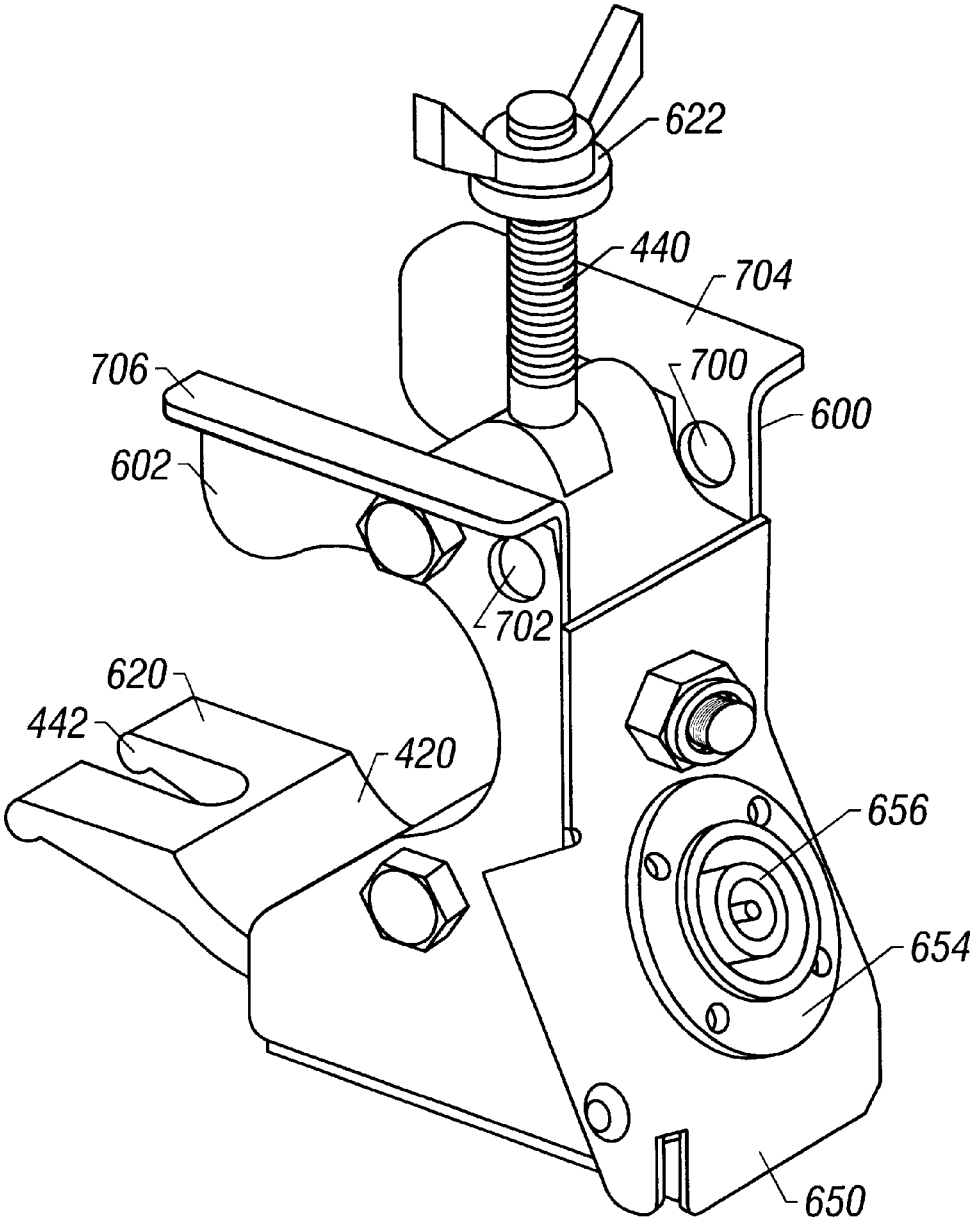
FIG. 7 shows an assembled view of the clamp of the present invention.

FIG. 6 shows an exploded view of the multiple parts making up the hook clamp of the second embodiment. It should be understood that these parts making up the exploded view are also the same parts which exist in the first embodiment. FIG. 7 shows the hook clamp fully assembled.

The hook clamp body is formed of two bent elements of sheet metal, including left member 600 and right member 602. Each has a cutout area defining a cylindrical surface 404 and defining flat surface 414. Members 600 and 602 are bolted to one another through a rear surface element 604. Element 604 has inner surfaces 606 defining substantially a portion of a cylinder. The hook clamp is bolted together to form an element having left 600 and right pieces 602, separated by the width of spacers 605, 611. Spacer elements 605 and 611 are provided between the central element 604 and the respective end elements 602 in order to prevent the tongue 420 and bolt 440 from pinching between the sheet metal elements 600, 602.

The rear surface element 604 also includes top and bottom split portions 610 and 612. Each of the split portions includes a movable element therein which is pivoted about a pivot point. The "top" split element 610 includes inner surfaces allowing bolt 440 to pivot therein. Bolt 440 pivots about pivot axis 614 to be swung up and out of the way for attachment of the lamp. Bolt 440 is later pivoted into position for securing the tongue. Lower split portion 612 includes inner surfaces allowing tongue 420 to pivot relative thereto along the tongue axis 422.

Tongue 420 also includes split portion 442 having surfaces 620 which are pressed against by corresponding surfaces 622 of the bolt. When the bolt 440 is tightened, the surfaces 622 press against the surfaces 620 to press tongue surfaces 424 closer to the rear surfaces 606. This has the effect of reducing the internal surfaces defining the cylindrical grip of the clamp, to thereby press the hook clamp more tightly against the cylindrical support 402.

The left and right pieces 600 and 602 include mounting holes 640 therein, preferably at a center of gravity of the clamp device. Mounting holes 640 receive screws for mounting the lamp 110.

The inventors of the present invention further recognized that electrical connection to the lamp could be facilitated by providing a connector which is a integral part of the lamp. This connector portion operates as shown and explained herein.

Figure 8:
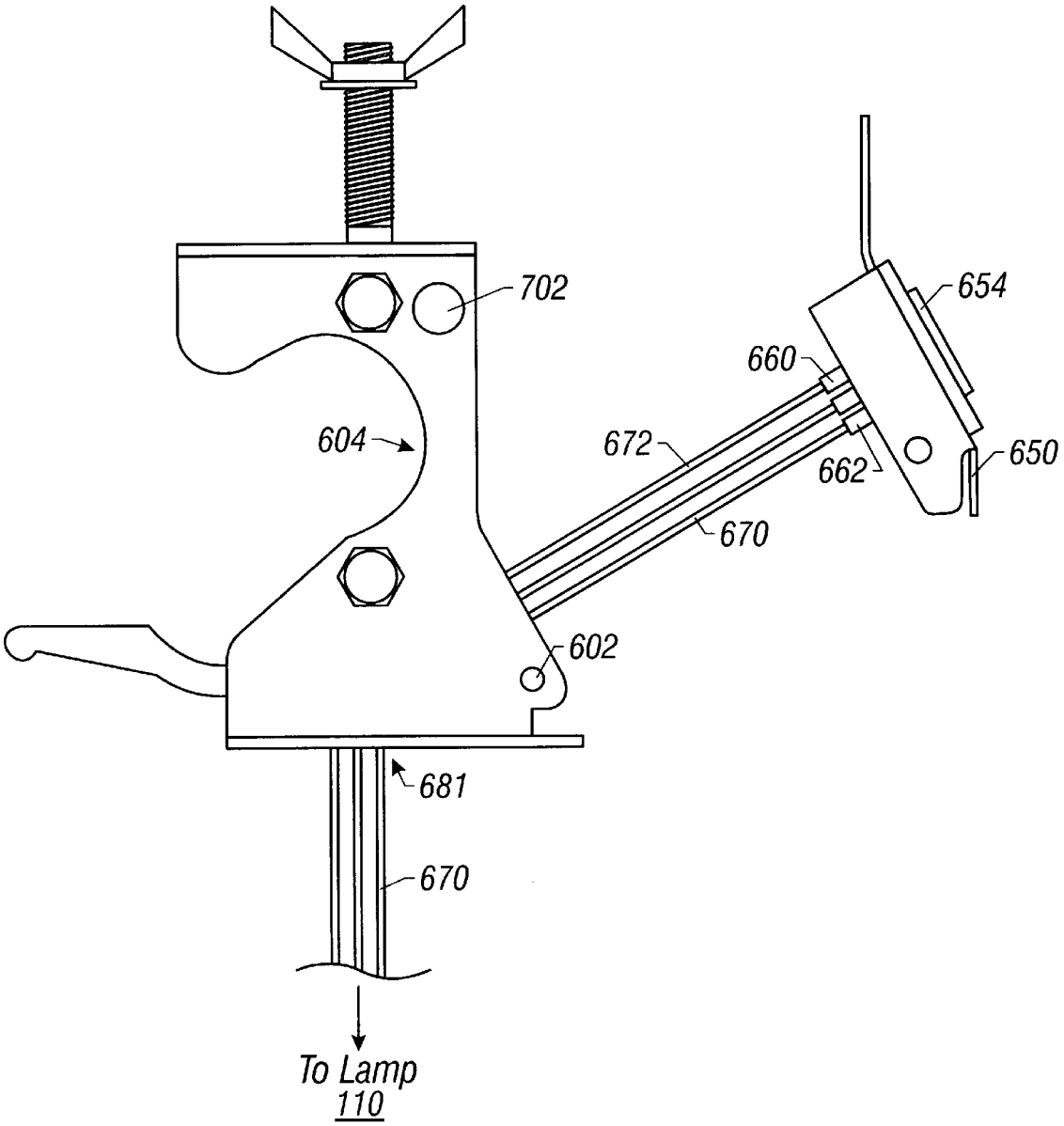
FIG. 8 shows a side view of the clamp and interface cable of the present invention.

The rear mounting plate 650 includes special inner surfaces 652 defining a hole of the proper size to receive a speak-on type connector 654. This connector is well known in the art, and is of the type typically used in the lighting industry. Of course, any suitable connector could be located in this position. The interface end 656 of the speak-on connector receives the power cable to provide power and/or control signals. FIGS. 7 and 8 shows the exit end 660 providing an output to interface cable 670. A wiring end 672 of interface cable 670 has its wire elements respectively connected to the connector terminals 662 of the connector 654. The interface cable 670 runs along the rear surface of the rear surface element 604, and into the inner surface hole of sliding connector.

FIGS. 7 and 8 show two fail-safe holes 700 and 702 provided in left and right pieces 600 and 602 respectively. A sturdy safety cable can be threaded through fail-safe holes 700 and 702 and around the cylindrical support 402 (or through some fixture attached to the lamp pole), to secure the hook clamp 400 to the cylindrical support 402, even if its tongue 420 is not yet secured against support 402. This allows a technician installing the lamp to secure the hook clamp and lamp assembly to the pole with a safety cable through at least one of the holes and around the supporting pole 402. The cable can remain securing the lamp and hook clamp, even in the event of any failure of the hook clamp mechanism.

Figure 9B:
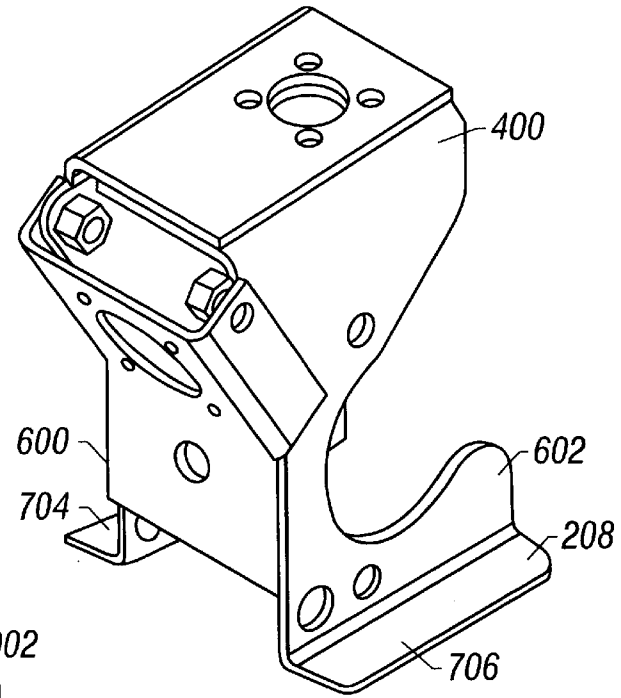
FIGS. 9A and 9B show an elevated view of the clamp and mounting bracket of the present invention.
Figure 9A:
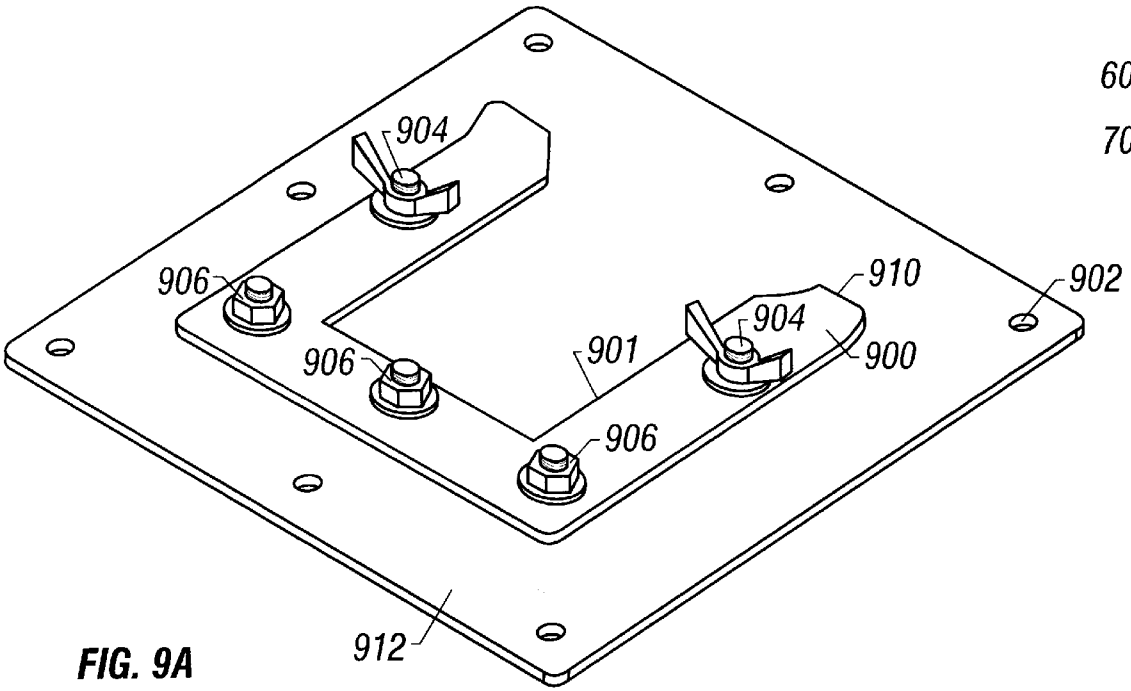
Figure 10:
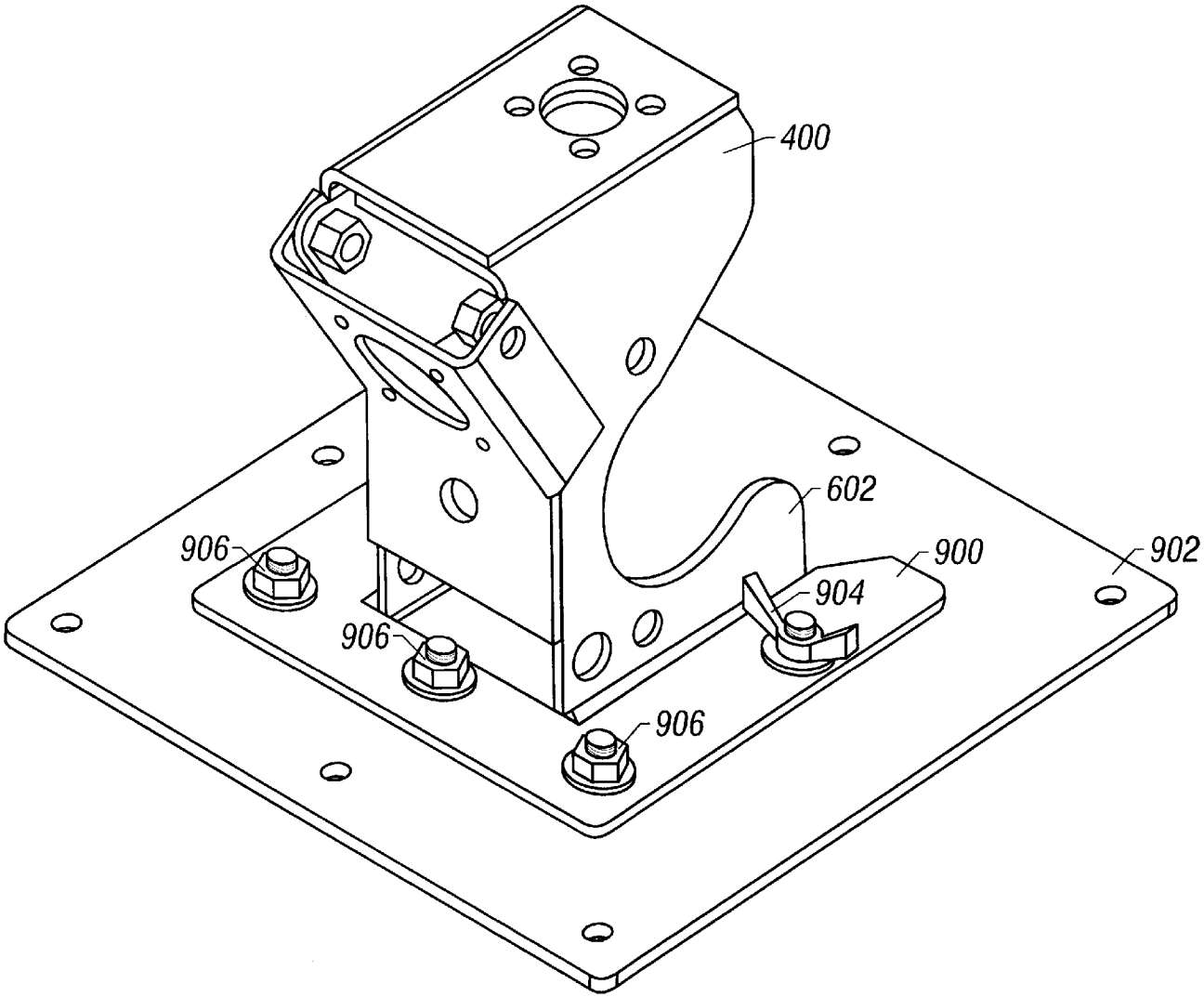
FIG. 10 shows an elevated view of the clamp and mounting bracket of the present invention mated together.

A particularly preferred and alternative embodiment of the invention enables an alternative mounting mechanism for the hook clamp. The left and right pieces of the hook clamp 602 are formed with special mounting flanges shown as 704, 706. The otherwise planar end pieces 602, 604, have mounting flanges which extend in a perpendicular direction to the plane formed by the left and right pieces. Those mounted flanges can be used for an alternative mounting system which is shown in FIGS. 9A, 9B and 10. The hook clamp mounting is shown in FIG. 9A, mounted in an upside down position as compared with the position of pole mounting. In this position, the flange surfaces 704, 706 hold the hook clamp in place, as compared with the normal position in which the inside surfaces 404, etc. hold the hook clamp in place. The flange 704, 706 have respective outer surfaces 708 which are held by a clamping mechanism 900. The clamping mechanism 900 include clamping surfaces 901 which respectively clamp against the clamped surfaces 708 of the hook clamp.

Clamping plate 902 includes a plurality of tightenable bolts 904, and a plurality of fixed bolts 906. When bolts 904 are loosened, the clamp 904 pivots relative to the fixed bolts 906. The clamping surface of clamp 900 at end 910 can be lifted up slightly from the underlying support 912. The end 910 preferably includes an upwardly extending flange which slips over the clamping surfaces 708. This facilities locating the surfaces 708 into their proper location. The entire clamping surface 901 of the clamp can be lifted slightly from the underlying surface 912. Once the clamping surfaces 708 are located into their proper position, the tightenable bolts 904 are tightened to thereby tightly press the tightening surfaces 901 against the corresponding tightening surfaces 708. The clamp in place is shown in FIG. 10. Note that the clamp surfaces hold the supporting pole in the same way as in the other manner of tightening. Moreover, the tongue portions are omitted from the FIGS. 9A, 9B and 10 figures, however, it should be understood that these tongue portions would preferably hold the lamp into place.

An important feature of this alternative embodiment is its ability to allow the lamp to be mounted into two different mounting locations using the same mounting structure.

Although only a few embodiments have been described in detail above, those having ordinary skill in the art will certainly understand that many modifications are possible in the preferred embodiment without departing from the teachings thereof.

All such modifications are intended to be encompassed within the following claims.

What is claimed is:

1. A load holding clamp adapted for attaching to a support which has a shaped outer surface, comprising:

a first portion having inner surfaces defining an inner perimeter adapted to be substantially the same shape as the shaped outer surface of the support; and an attachment portion, connected to hold a load, connected to said first portion, said inner surfaces including a portion which when coupled to said first portion supports said load in a stable position, and, a movable portion having second inner surfaces and also adapted to have substantially the same shape as the shaped outer surface of the support and including a tightening mechanism which can be tightened to clamp said first portion to said support and wherein said first portion supports the load in the stable position prior to said tightening mechanism being tightened.

2. The clamp as in claim 1, wherein said first portion includes edge surfaces of a shaped sheet metal piece.

3. A clamp as in claim 2 wherein said first portion is formed of two shaped sheet metal pieces, each having an inner edge perimeter defining a portion of a circle.

4. A clamp as in claim 1 further comprising a cylindrical support, and said inner surface defines an inner perimeter which is a portion of a circle.

5. A clamp as in claim 1 further comprising an entry hole loaded in a position allowing electric power to be routed to the load.

6. A clamp as in claim 1 further comprising a flange portion on each of said sheet metal pieces, said flange portion operating to allow connection to a second support structure, different than said support, said second support structure having first and second parts which clamp said flanges therebetween.

7. The hook clamp of claim 1 further comprising first and second flange portions, attached to said hook clamp body, and respectively forming clamping surfaces which can be clamped separately from said cylindrical surface.

8. A load-holding clamp adapted for attaching to a support which has a shaped outer surface, comprising:

a first portion having inner surfaces defining an inner perimeter which is adapted to be substantially the same shape as the shaped outer surface of the support; and an attachment portion, connected to hold a load, connected to said first portion, said inner surfaces including a portion which when coupled to said first portion supports said load in a stable position, and, a movable portion having second inner surfaces and also adapted to have substantially the same shape as the shaped outer surface of the support and including a tightening mechanism which can be tightened to clamp said first portion to said support, wherein said first portion includes edge surfaces of a shaped sheet metal piece, wherein said sheet metal piece includes at least one fail safe hole therein at a location allowing a cable to be attached around said support.

9. A stage lighting support clamp, comprising:

a housing, having a) a load attachment portion, b) a hook-shaped supporting portion, having an inner portion in the shape of a hook which can hook over a first shaped support element and supports the housing and any stage light attached to the load attachment portion, and c) an alternative mounting portion, located spaced from said hook-shaped portion having surfaces for attachment to a clamping support, different from said first shaped support element and using different surfaces than said hook shaped retaining portion, said second supporting portion being in a location opposite said first supporting portion in a way such that attachment to said first supporting portion supports said light in a first orientation, and said second supporting portion supports said lamp in a second orientation different than said first orientation.

10. The clamp as in claim 9, wherein said first orientation is right side up, and said second orientation is upside down.

11. The clamp as in claim 9 wherein said first shaped supporting element is a cylindrical element, and said inner portion defines a section of a circle, and said alternative mounting portion includes flat surfaces adapted for attaching to a floor mounted clamping device.

12. A clamp as in claim 9 further comprising a lamp, attached to said load attachment portion, wherein said first orientation includes said lamp being oriented in a first direction at a bottom of said clamp when mounted, and said second orientation is said lamp turned completely upside down relative to said first direction and mounted at a top of said clamp when mounted.

13. A clamp as in claim 9 further comprising a floor clamp, having a first flat portion with a bottom surface adapted to be located against the floor, said first flat portion having a sufficient size to support a lamp, and a second clamping portion, which is tightened and loosened relative to said flat portion to thereby allow said alternative mounting portion to be placed between said clamping portion and said flat portion when loosened, and to hold said alternative mounting portion when tightened.

14. A clamp with a connector interface, comprising:

a shaped support;

a first hook-shaped portion, shaped for connection to the shaped support, said first portion having surfaces that are hooked over the support and which maintain an attached lamp in position relative to the support, and a clamping connection part which is adjustable to press said surfaces which are hooked over the support relative to said support, said first portion including inner surfaces defining an opening therein; and an electrical connector, disposed in said opening, and having a connector interface area facing said support mechanism, and receiving an electrical wire therefrom.

15. A clamp as in claim 14 wherein said opening is substantially circular to receive a substantially circular outer-perimeter connector.

16. A clamp as in claim 15 wherein said first hook-shaped portion comprises a first flat portion which is shaped to have inner surfaces defining a hook shape, a second flat portion which is similar in shape to said first portion, and opposed thereto and spaced by a predetermined distance, and a third portion located between said first and second flat portions, said third portion including said surfaces defining the circular opening.

17. A hook clamp for holding a lamp comprising:

a cylindrical support of a first size and shape, comprising:

a first base portion, comprising inner surfaces including a first inner surface having a cylindrical shape, which is substantially the first size and shape that is the same as an outer shape of said support, said base portion including at least a first hook portion which forms a cylindrically-inner shaped notch portion having inner surfaces which are substantially cylindrically shaped, said hook portion hooking over the cylindrical support to form a first portion which extends below a top of the support on a first side to form a hooked area, a second portion which is substantially the first size and shape as an outer shape of said support, and which extends on a second side of the support, and an opening, said first base portion including inner surfaces defining an opening therein, and including an electrical connector disposed in said opening;

a movable portion, movable relative to said first portion between a first position where said opening is open, and a second position where said opening is closed, and a closure mechanism, connected to said first position and said movable portion, and connectable between said first and movable portions when said movable portion is located in said second position to close said opening, and selectively tightened to tighten inner surfaces of said first portion against said support.

18. The hook clamp as in claim 17 further comprising a cylindrical support, and wherein said first inner surface is substantially cylindrically shaped with substantially the same size and shape as an outer shape of said cylindrical support.

19. A hook clamp, comprising:

a hook clamp body formed of two hook-shaped elements of sheet metal, each of said shaped elements being similar in shape, forming a left side member and a right side member, each said member including a cutout area defining an arc of a cylindrical surface, a bolting element, bolting said left side member to said right side member, and a rear surface element, said rear surface element including a cutout surface therein, said cutout surface including an electrical connector, and a connection to a stage lamp, said connection being rigidly connected to said hook clamp body, and said connector including an electrical connection to said stage lamp.

20. A method of connecting a stage light with a connected hook clamp, to a support, comprising;

first connecting a first stage light with a first hook clamp having a first surface connected to a first support, said first connecting mounting the stare light in a first orientation, such that said stage light is at a bottom portion of the hook clamp; and second connecting a second stage light with a second hook clamp, that is substantially identical to said first hook clamp, having a second surface different than said first surface, to a second support different than said first support in a second direction, such that said second stage light is at a top portion of the hook clamp.

21. A hook clamp for holding a lamp relative to a cylindrical support, comprising:

a first base portion, comprising inner surfaces including a first inner surface having a cylindrical shape, which is substantially the same size and shape as an outer shape of said support, said base portion including at least a first hook portion which forms a cylindrically-inner shaped notch portion having inner surfaces which are substantially cylindrically shaped, said hook portion hooking over the cylindrical support to form a first portion which extends below a top of the support on a first side to form a hooked area, a second portion which is substantially the same size and shape as an outer shape of said support, and which extends on a second side of the support, and an opening, said first base portion including inner surfaces defining an opening therein, and including an electrical connector disposed in said opening;

a movable portion, movable relative to said first portion between a first position where said opening is open, and a second position where said opening is closed, and a closure mechanism, connected to said first position and said moveable portion, and connectable between said first and moveable portions when said moveable portion is located in said second position to close said opening, and selectively tightened to tighten inner surfaces of said first portion against said support, wherein said first base portion further comprises flange portions, opposing one another and spaced from said inner surfaces, said flange portions adapted for holding said lamp in a different orientation than said cylindrical portions.

22. A hook clamp, comprising:

a hook clamp body formed of two hook-shaped elements of sheet metal, each of said shaped elements being similar in shape, forming a left side member and a right side member, each said member including a cutout area defining an arc of a cylindrical surface, a bolting element, bolting said left side member to said right side member, and a rear surface element, said rear surface element including a cutout surface therein, said cutout surface including an electrical connector, and a connection to a stage lamp, said connection being rigidly connected to said hook clamp body, and said connector including an electrical connection to said stage lamp, further comprising flange portions on each of said shaped elements.

23. The hook clamp as in claim 22 further comprising a floor clamp, a floor clamp, having a first flat portion with a bottom surface adapted to be located against the floor, said first flat portion having a sufficient size to support a lamp, and a second clamping portion, which is tightened and loosened relative to said flat portion to thereby allow said alternative mounting portion to be placed between said clamping portion and said flat portion when loosened, and to hold said alternative mounting portion when tightened.

24. The hook clamp as in claim 22 further comprising a cylindrical support portion, and wherein said cutout surface is substantially the same size and shape as said support portion.

25. The hook clamp of claim 24 further comprising a fail safe cutout hole formed in at least one of said shaped elements, and a cable, wrapped through said cutout hole and around said support member to maintain a fail safe connection.

* * * * *